United States Patent [19]

Ozaki et al.

[11] 4,209,365

[45] Jun. 24, 1980

[54] PROCESS FOR MANUFACTURING DIELECTRIC MEMBER

[75] Inventors: Yoshihiro Ozaki, Isehara; Masayuki Kuniyoshi, Sagamihara; Takanobu Ishido, Yokohama; Shuichiro Kaneko, Mitaka; Yasukuni Omata, Hachioji, all of Japan

[73] Assignee: Minolta Camera Kabushiki Kaisha, Osaka, Japan

[21] Appl. No.: 974,524

[22] Filed: Dec. 29, 1978

[30] Foreign Application Priority Data

Dec. 29, 1977 [JP] Japan ..... 52-157682
Dec. 29, 1977 [JP] Japan ..... 52-157683

[51] Int. Cl.[2] ..... C25D 11/08
[52] U.S. Cl. ..... 204/14 N; 204/36
[58] Field of Search ..... 204/14 N, 36

[56] References Cited

U.S. PATENT DOCUMENTS 1,869,042 7/1932 Bengston ..... 204/36
1,869,058 7/1932 Gower ..... 204/36

FOREIGN PATENT DOCUMENTS 895695 5/1962 United Kingdom ..... 204/14 N

OTHER PUBLICATIONS

Electroplating Engineering Handbook; A. K. Graham, Editor; Reinhold, 1962, pp. 76–77.

*Primary Examiner*—John H. Mack
*Assistant Examiner*—William Leader
*Attorney, Agent, or Firm*—Wenderoth, Lind & Ponack

[57] ABSTRACT

A process for manufacturing a dielectric member from aluminum or aluminum alloy which includes the steps of subjecting the aluminum or aluminum alloy to anodic oxidation in a nonaqueous electrolytic solution containing an organic solvent and dehydrated boric acid to form an oxide layer thereon, and buffing the oxide layer with a composition containing insulative abrasive grains and insulative binding material.

5 Claims, 9 Drawing Figures

PROCESS FOR MANUFACTURING DIELECTRIC MEMBER

BACKGROUND OF THE INVENTION

The present invention relates to a process for manufacturing a dielectric member or more particularly, to a process for manufacturing a dielectric member from aluminum or aluminum alloy (referred to as aluminum hereinbelow) which includes the steps of subjecting the aluminum to anodic oxidation or anodizing to form thereon an oxide layer superior in electrical insulation and charging characteristics, and subsequently subjecting said oxide layer to surface treatment for further improvement of the electrical insulation and smoothness.

Commonly, for anodic oxidation or anodizing of aluminum, the anodizing processes utilizing sulfuric acid or oxalic acid as electrolyte have been most widely adopted. The conventional anodizing processes as described above, however, have such disadvantages that, since the electrolyte employed therein is in the form of aqueous solution, electrical insulation of the anodized or oxide layer formed thereby is low in volume resistivity, only approximately $10^9$ Ω·cm, and thus the known processes as described above can not be applied to materials for which still higher electrical insulation is required.

On the other hand, various anodic oxidation processes employing electrolytes in the form of non-aqueous solutions have also been conventionally proposed, for example, in Japanese Patent Publication Tokkosho 39/18636 in which formamide and boric acid are employed as electroyte for simultaneously carrying out coloring through one process of anodic oxidation. The anodized or oxide layer obtained by the known process as described above is slightly better as electrical insulation than that available by the earlier described processes utilizing the electrolyte in the form of an aqueous solution, but still has insufficient electrical insulation in the region of approximately $10^{10}$ to $10^{11}$ Ω·cm, thus not being suitable for cases where electrical insulation higher than $10^{12}$ Ω·cm is required.

Furthermore, since the oxide layers formed by the known methods as described above are porous, they are active immediately after the formation thereof, and for rendering these oxide layers stable, pore sealing or filling treatment is normally effected with the use of pressurized steam or boiling water. Although inlets to the pores of the porous oxide layer are completely closed by the formation of hydroxides through the pore filling treatment, smoothness on the surface of the oxide layer is hardly improved. Moreover, the pore filling treatment with the use of the boiling water and the like has such a serious disadvantage that the insulating property of the oxide layer is deteriorated, with marked reduction of charged surface potential to be imparted to the surface of the oxide layer.

Consequently, the dielectric members obtained by the conventional anodic oxidation or anodizing processes have such disadvantages that they are poor as electrical insulation, thus not being suitable for uses in which high electrical insulation is required, for example, in electrostatic type printers, electrophotographic copying apparatuses, etc., and their smoothness and electrical charging characteristics are not improved.

SUMMARY OF THE INVENTION

Accordingly, an essential object of the present invention is to provide an improved process for manufacturing dielectric members from aluminum or aluminum alloy.

Another important object of the present invention is to provide an improved process as described above for producing dielectric members which have high electrical insulation at least higher than $10^{12}$ Ω·cm in volume resistivity, with superior electrical charging characteristics.

A further object of the present invention is to provide an improved process as described above which includes a novel step of subjecting the aluminum to anodic oxidation or anodizing.

A still further object of the present invention is to provide an improved process as described above which further includes a novel step for subjecting the anodized aluminum to a surface treatment.

In accomplishing these and other objects, according to one preferred embodiment of the present invention, there is provided a process for manufacturing a dielectric member having volume resistivity of at least $10^{11}$ Ω·cm from aluminum and aluminum alloy which comprises a first step of subjecting the aluminum or aluminum alloy to anodic oxidation in a non-aqueous solution including organic solvent and dehydrated boric acid to form an oxide layer on the aluminum or aluminum alloy, and a second step of buffing the surface of said oxide layer to seal the pores thereof.

By the process of the invention as described above, dielectric members having high electrical insulation at least higher than $10^{12}$ Ω·cm in volume resistivity and superior electrical charging characteristics have been advantageously presented, with substantial elimination of disadvantages inherent in the conventional processes of the kind described above.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
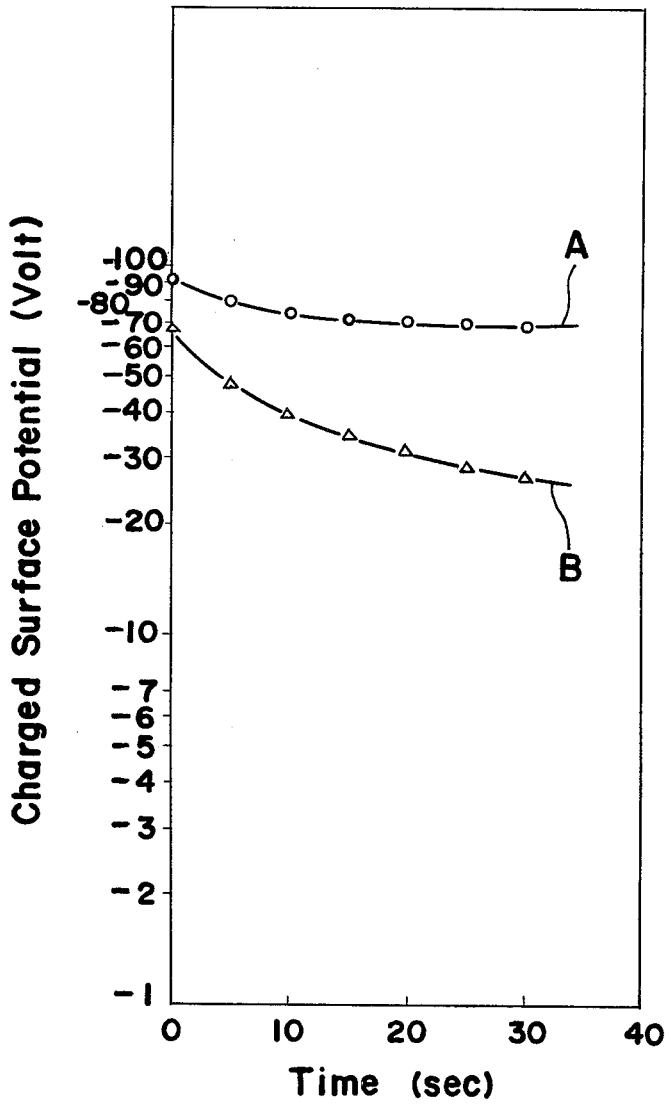
FIG. 1 is a graph showing electrical charging characteristics of an oxide layer obtained by the anodic oxidation employing dehydrated boric acid according to the present invention, and those of an oxide layer obtained by the use of boric acid which is not dehydrated.

In the first place, it is to be noted that, according to the process for manufacturing the dielectric member of the present invention mainly aiming at obtaining the dielectric member which has volume resistivity higher than $10^{12}$ Ω·cm, aluminum or aluminum alloy is subjected to anodic oxidation or anodizing in the first step. The anodic oxidation is effected at comparatively low electrolytic temperatures of approximately 30° to 40° C. with the employment of a non-aqueous electrolyte solution composed of organic solvent and dehydrated orthoboric acid (referred hereinafter as dehydrated boric acid).

The dehydrated boric acid referred to above is prepared by heating boric acid at a temperature of approximately 80°±10° C. for more than one hour. For the organic solvent medium, it is preferable to make use of formamide, N-methyl formamide dimethyl formamide or an alcohol, as they are quite excellent in dissolving the dehydrated boric acid. The temperatures of the electrolyte are set to be 30° to 40° C. because at temperatures lower than 30° C., boric acid starts to be deposited to hinder favorable anodic oxidation, while at temperatures higher than 40° C., the charging characteristics of the oxide layer no longer improve.

The dehydration treatment of boric acid (more precisely, orthoboric acid) is effected at the temperatures of approximately 80°±10° C. as described above, since at temperatures higher or lower than that, not only the electrical charging characteristics are remarkably lowered, but oxide layers to be formed tend to have poor smoothness. Meanwhile, it is preferable that the weight ratio of the organic solvent to dehydrated boric acid constituting the electrolyte is approximately 2 : 1, since at ratios other than the above, electrically charging characteristics of the dielectric member are deteriorated.

Although the dielectric layer itself to be formed on the aluminum support member by the anodic oxidation as described above is of highly insulative nature having volume resistivity of at least $10^{12}$ Ω·cm, with superior surface hardness and smoothness, further improvement of electrical insulation and smoothness may be required depending on uses. For example, when the dielectric member is to be used as a dielectric recording medium in an electrostatic type printer, the electrostatic latent image is formed on the surface thereof, for example, by functioning of a needle electrode, while the dielectric member is to be subjected to cleaning for repeated use as the latent image is developed and transferred, and thus, the dielectric layer is required to have high electrical insulation and sufficient smoothness. For the above purpose, according to the present invention, the dielectric layer formed in the manner as described above is further subjected to polishing by buffing with a composition containing insulative abrasive grains and insulative binding material. Commonly, the oxide layers formed by the anodic oxidation process as described above, or conventional anodic oxidation processes, are porous, and by buffing the oxide layers, the compounds employed as the polishing agent make the surface of the oxide layers smooth, while they are filled into pores for adhesion thereto to seal the pores of the oxide layers. Therefore, not only the inner faces of the pores are made inactive to prevent reduction of insulation due to moisture content in the air, but the insulation of the oxide layers is further improved, thus oxide layers (insulative layers) with superior charging characteristics being obtainable.

It should be noted here that the buffing as described in the foregoing is not limited in its application to the oxide layer obtained by the anodic oxidation process according to the present invention, but may be applied to oxide layers formed by other anodizing methods with similar effect achieved.

For the electrically insulative grains of the polishing compound, metallic oxides having high electrical insulation such as alumina, chromium oxide, iron oxide, etc. are suitable, while, for the electrically insulative binding agent, various organic materials such as fats and fatty oils, paraffins and waxes as well as various high-molecular weight compounds, for example, fluorine plastics, silicone resin, polyethylene, etc. may be employed. In the examples of the present invention, chromium oxide powder hardened by wax was used. Meanwhile, for materials of a polishing base, ordinary materials such as woven fabrics, emery paper, felt, etc. can be used.

Hereinbelow, examples and comparative data are inserted for the purpose of illustrating the present invention with reference to the drawings, without any intention of limiting the scope thereof.

EXAMPLE 1

A sample aluminum plate of 50×50×1 mm in size (prepared by material specified in JIS (Japanese Industrial Standards) No. 5052) was subjected to the preliminary washing in a known manner through degreasing by detergent, water rinsing, alkali degreasing, rinsing, nitric acid neutralization, and water rinsing. By using the aluminum plate thus treated as an anode, with another aluminum plate disposed therearound as a cathode, the anodic oxidation is effected under the conditions as follows. For the dehydration of boric acid, the boric acid was placed in a thermostat (not shown) to be heated by a nichrome wire at 80°±10° C. for 2 hours.

| | |
|---|---|
| Electrolyte formamide | 67 weight % |
| dehydrated boric acid | 33 weight % |
| (For dehydration, boric acid was heated at 80 ± 10° C. for 2 hours) | |
| Electric current | 2A/dm$^2$ |
| Electrolyte temperature | 30–40° C. |
| Electrolytic time | 20 minutes |

By the above procedure, an oxide layer of 20μ in thickness was obtained.

Comparative experiment 1

With the electrolyte of EXAMPLE 1 replaced by an electrolyte composed of 67 weight % of formamide and 33 weight % boric acid which is not dehydrated, the anodic oxidation was carried out in the similar manner as in EXAMPLE 1 to form an oxide layer on another sample aluminum plate.

The sample aluminum plates thus obtained in EXAMPLE 1 and comparative experiment 1 were charged by the corona charged under the same conditions for subsequent measurements of variations of surface potentials with time. The results of measurements are shown in FIG. 1. However, it should be noted that initial surface potential of samples in FIG. 1 is not a saturated surface potential as it may be charged to surface potential as high as 1,000 volts in accordance with changes of outputs of the corona charger. For the assessment of the charging characteristics, comparison was first made as to how high the charged surface potentials were and how small the decay of the charged surface potentials was under the same conditions. For remaining experiments described hereinbelow, samples were changed by corona charger under same conditions. As is seen from FIG. 1, the charged surface potentials at the initial stage were 94 V for the sample treated by the dehydrated boric acid as shown in a curve A, and 67 V for the sample using the ordinary boric acid as represented by a curve B, while the decay characteristics after 30 seconds were at 70 V for the former and 25 V for the latter, with a marked difference being noticed therebetween. Meanwhile, upon measurements of volume resistivity, the sample treated by the conventional method had a value of $10^{10}$ Ω·cm, while that treated by the method of the present invention showed a value of approximately 10 Ω·cm.

EXAMPLES 2–4

Figure 2:
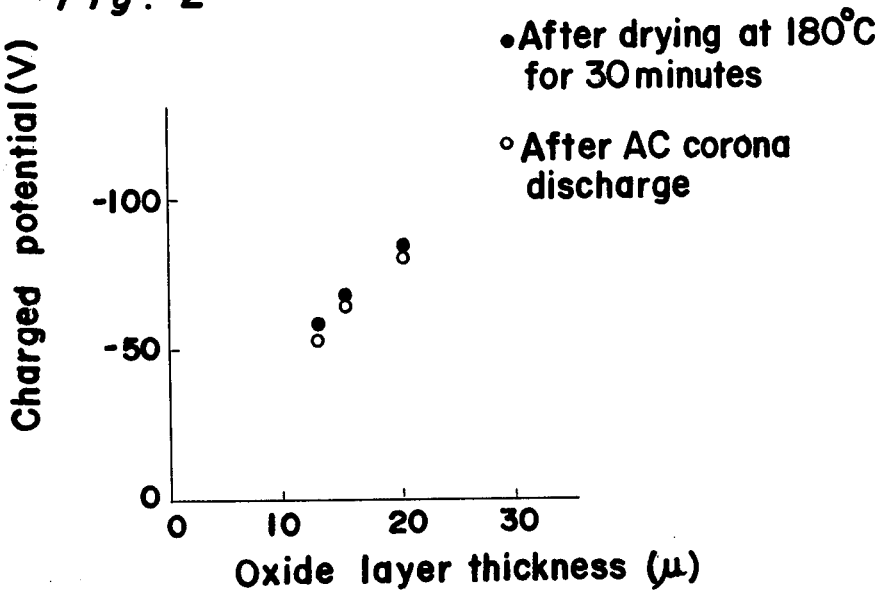
FIGS. 2 and 3 are graphs each showing relation between thickness of oxide layer and electrical charging potential.

Under the same conditions as in EXAMPLE 1, oxide layers respectively having thicknesses of 13μ, 15μ and 20μ were formed on sample aluminum plates. Subsequently, each of the oxide layers was subjected to (a) drying for 30 minutes at a temperature of 180° C. and (b) AC corona discharge, and thereafter, measured for potential charged by the same corona charger. The results of the measurements are shown in FIG. 2. From this, it can be seen that oxide layers of the present invention exhibit fine charging characteristics with stable reproducibility.

Comparative experiments 2–4

Figure 3:
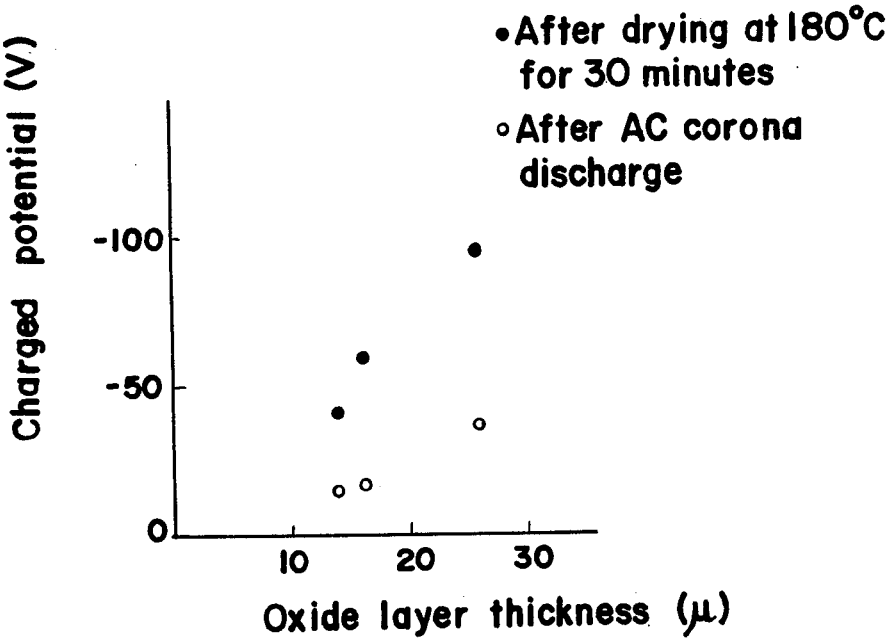

Under conditions similar to those in EXAMPLE 1, with the electrolyte temperature controlled to be 50° to 60° C., oxide layers of 14μ, 16μ and 26μ in thickness were formed on sample aluminum plates. Subsequently, each of the oxide layers was treated under the same conditions as in the items (a) and (b) in EXAMPLE 2–4, and thereafter, measured for the potentials imparted by the same corona charger. The results of the measurements are shown in FIG. 3. From this, it can be seen that oxide layers obtained under high temperatures will result in poor charging characteristics with unstable reproducibility.

Therefore, the temperatures of the electrolyte for the anodic oxidation should preferably be in the range between 30° and 40° C.

Subsequently, to obtain the weight ratio of formamide to dehydrated boric acid as non-aqueous solution type electrolyte, and also to see if metaboric acid can replace boric acid, further comparative experiments were carried out as described hereinbelow.

Comparative experiment 5

Figure 4:
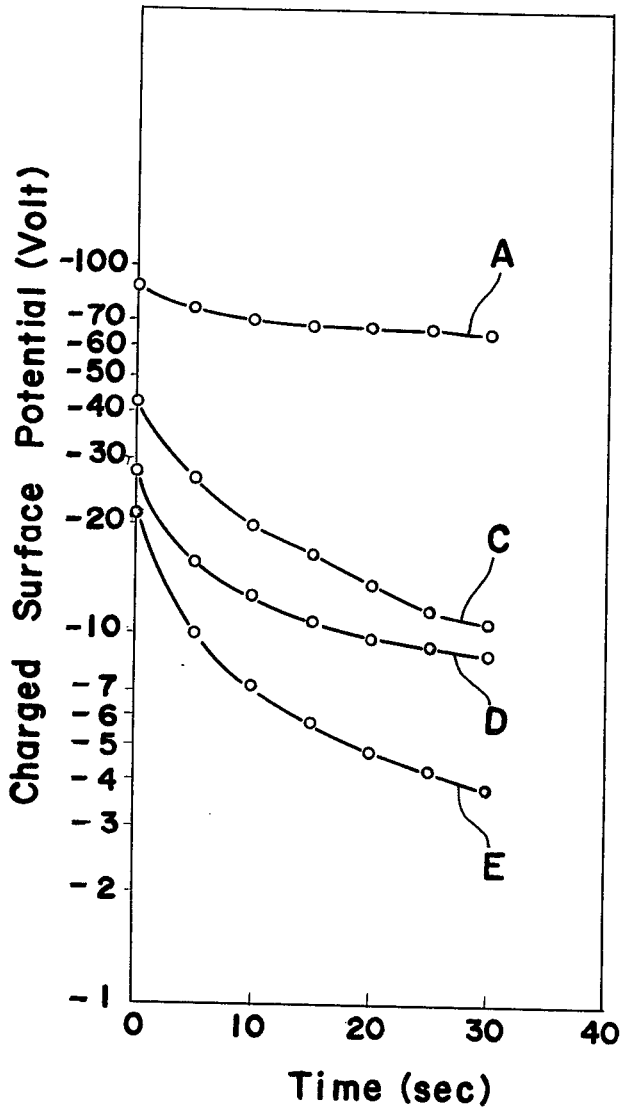
FIG. 4 is a graph showing electrical charging characteristics of oxide layers to be formed according to various weight ratios of formamide to boric acid constituting the electrolytes employed.

With the electrolyte of EXAMPLE 1 replaced by an electrolyte composed of 80 weight % of formamide and 20 weight % of dehydrated boric acid, the anodic oxidation was carried out under the same conditions as in EXAMPLE 1 to obtain an oxide layer approximately 20μ thick, the charging characteristics of which are shown by a curve C in FIG. 4 for comparison with the curve A representing the charging characteristics of the oxide layer obtained in EXAMPLE 1.

Comparative experiment 6

With the electrolyte of EXAMPLE 1 replaced by an electrolyte composed of 90 weight % of formamide and 10 weight % of boric acid without dehydration, the anodic oxidation was carried out under the same conditions as in EXAMPLE 1 to obtain an oxide layer approximately 20μ thick, the charging characteristics of which are shown by a curve D in FIG. 4.

Comparative experiment 7

With the electrolyte of EXAMPLE 1 replaced by an electrolyte composed of 70 weight % of formamide and 30 weight % of metaboric acid without dehydration, the anodic oxidation was carried out under the same conditions as in EXAMPLE 1. In the above case, voltage rise was hardly noticeable, without formation of a desirable oxide layer, and the thickness of the resultant oxide layer was only about 10μ. The charging characteristics of the oxide layer are shown by a curve E in FIG. 4.

As is clear from the results shown in FIG. 4, the oxide layer obtained in the comparative experiment 5 (represented by the curve C) is capable of being charged the highest by a corona charger under the same condition as in the case of curve A, and its decay speed is extremely high, and its dark attenuation speed is extremely high, with reduction down to approximately −12 V after 30 seconds. Similarly, the oxide layer available by the comparative experiment 6 (represented by the curve D) is not suited to practical application as a dielectric member, with the surface potential of −28V and potential of approximately −9 V after 30 seconds. Moreover, as for the oxide layer to be obtained in the comparative experiment 7 (represented by the curve E), the charging potential available is limited only up to −21 V, with a high decay rate thereof.

On the contrary, the oxide layer obtained by the anodic oxidation process according to the present invention is capable of being charged up to a very high potential, with an extremely low decay rate. Therefore, it is preferable that the organic solvent medium and dehydrated boric acid should be used in a 2:1 in weight ratio, while metaboric acid is not suitable for use in the process according to the present invention. In the present invention, the use of the dehydrated boric acid contributes to manufacturing of the highly insulative dielectric member, and said dehydrated boric acid means boric acid subjected to the heating and dehydration for more than 1 hour at the temperature of 80°±10° C. as described earlier.

For proving that the dehydration temperature in the region of 80°±10° C. is preferable, another experiment was carried out, with employment of boric acid subjected to the dehydration at a comparatively high temperature as described in the comparative experiment 8 below.

Comparative experiment 8

With the electrolyte of EXAMPLE 1 replaced by an electrolyte composed of 67 weight % formamide and 33 weight % of boric acid subjected to the dehydration for 2 hours at 160° C., the anodic oxidation was carried out under the same conditions as in EXAMPLE 1, and the resultant sample thus obtained was charged by the corona charger for evaluation of the decay characteristics.

Figure 5:
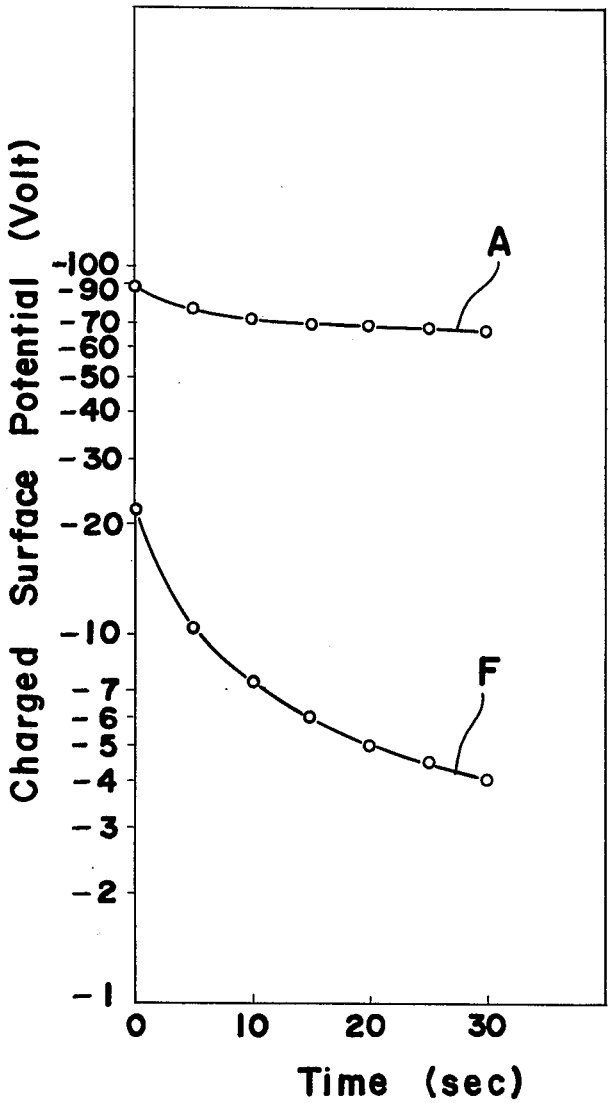
FIG. 5 is a graph showing electrical charging characteristics of oxide layers obtained according to temperatures for dehydration of boric acid.

The result was such that, as is seen from a curve F in FIG. 5, the sample was capable of being charged only up to approximately −22 V by a corona charger under the same condition as in the case of curve A, with the decay down to −4 V in 30 seconds. The above result is remarkably inferior as compared with the characteristics of the dielectric member obtained by the process according to the present invention and represented by the curve A. Accordingly, it is seen that the optimum dehydration temperature of boric acid is 80° C.±10° C.

Figure 6:
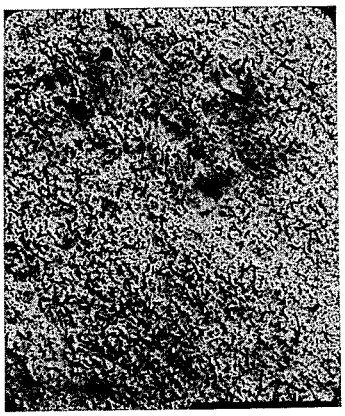
FIG. 6 is a photograph by an electron microscope showing macro-structure of the oxide layer of aluminum.
Figure 7:
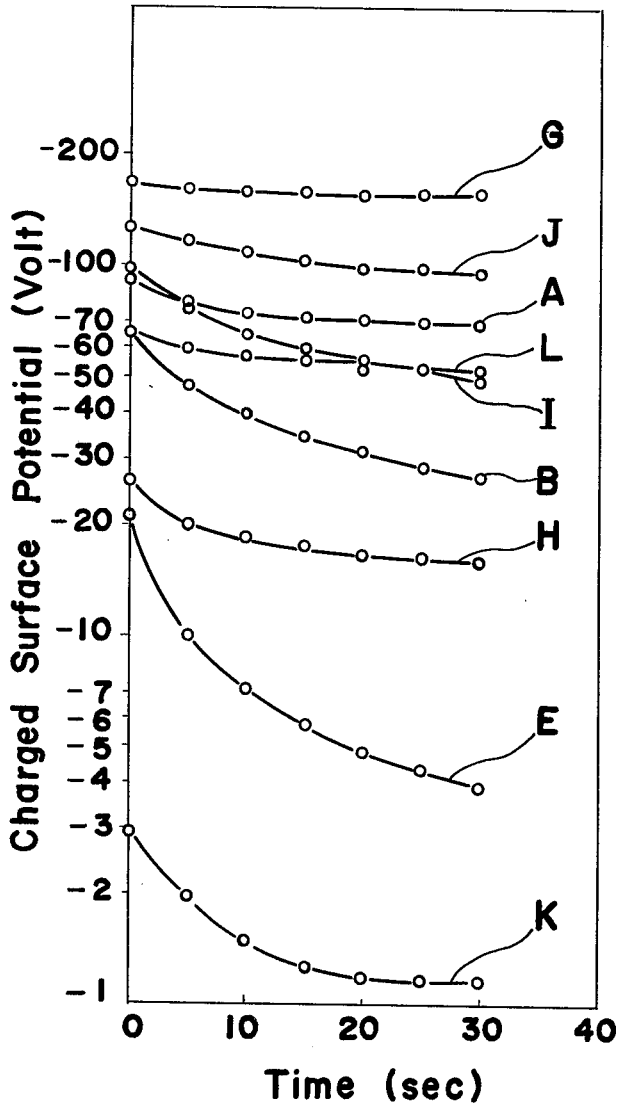
FIG. 7 is a graph showing electrical charging characteristics of various oxide layers formed in accordance with the present method with some of the layers subjected to the surface treatments, and of oxide layers formed in accordance with various methods departing from the method of the present invention.

Incidentally, the macro-structure of the oxide layer (20μ in thickness) obtained in EXAMPLE 1 is porous as shown in an electron microscope photograph of FIG. 6, while the roughness on the surface thereof was measured to be 6 to 8μ at the maximum ($R_{max}$). In the electron microscope photograph of FIG. 6 at magnification of 30,000, the black portions are considered to be pores. Although the charging characteristics of the oxide layer obtained by EXAMPLE 1 are represented by the curve A in FIG. 7, anodic oxidation layers were prepared by various other methods for comparison therewith, part of which are subjected to the surface treatment for investigation into the respective charging characteristics (charged potential decay characteristics) thereof.

EXAMPLE 5

Figure 9:
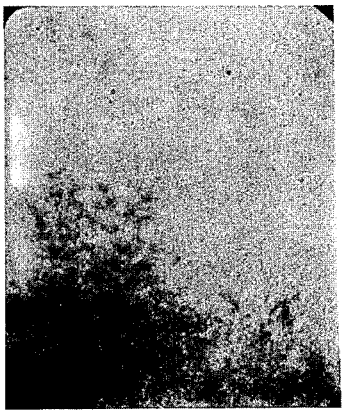

The surface of the oxide layer having thickness of 20μ and volume resistivity of $10^{12}$ Ω·cm and obtained in EXAMPLE 1 was subjected to polishing by buffing with the use of a polishing material prepared by pressing a compound composed of fine particles of chromium oxide solidified with wax against felt as a polishing base. As a result, the pores in said surface were perfectly sealed as shown in the electron microscope photograph in FIG 9, with remarkably superior smoothness being achieved thereon. By way of example, the roughness on the surface was 2 to 4μ ($R_{max}$) at the maximum, and the volume resistivity was improved up to $2\times10^{13}$ Ω·cm (electrostatic capacitance 210 pF/cm$^2$). The dielectric member thus treated on the surface thereof was subjected to charging by the corona charger for measuring the electrical charging characteristics thereof, with findings as shown in a curve G of FIG. 7. As against the surface potential of 94 V immediately after the charging and the surface potential of 70 V after 30 seconds for the dielectric member (represented by the curve A) which had not been subjected to the surface treatment, the dielectric member subjected to the surface treatment was markedly improved in its charging characteristics, with the surface potential of 170 V immediately after the charging and that of 160 V after 30 seconds.

EXAMPLE 6

Under the same conditions as in EXAMPLE 1, anodic oxidation was carried out at electrolytic temperatures of 50° to 60° C. with employment of boric acid not subjected to the dehydration. The resultant oxide layer had a thickness of 19μ and electrostatic capacity of 2,100 pF/cm$^2$. Upon measurement of the charging characteristics of said oxide layer, the initial surface potential was 27 V, with decay thereof down to 16 V in 30 seconds, thus being unsuitable for practical application as dielectric member. Subsequently the surface of said oxide layer was polished by buffing with the use of a polishing material prepared by pressing fine particles of chromium oxide against emery paper as a polishing base. The electrical characteristics of the dielectric member subjected to the surface treatment as described above showed an improvement as shown by a curve I in FIG. 7, with the surface potential of −100 V and that of −49 V after elapse of 30 seconds. The dielectric member treated as described above and having electrostatic capacity of 1,030 pF/cm$^2$, however, is still unsuitable for practical use owing to its high decay speed. Meanwhile, the surface of the same oxide layer was subjected to polishing by buffing with the use of another polishing material prepared by pressing a compound composed of fine particles of chromium oxide solidified with wax against felt as a polishing base. The charging characteristics of the oxide layer thus treated were as shown by a curve J in FIG. 7, and the initial stage surface potential was up to −140 V, while the attenuated potential thereof after 30 seconds was −100 V, with electrostatic capacity of 550 pF/cm$^2$. Although the above results are somewhat inferior to those represented by the curve G, the charging characteristics are considerably improved as compared with the case in which the oxide layer is polished with the fine particles of chromium oxide alone as represented by the curve I, thus indicating that the surface treatment according to the present invention is very effective.

Comparative experiment 9

Figure 8:
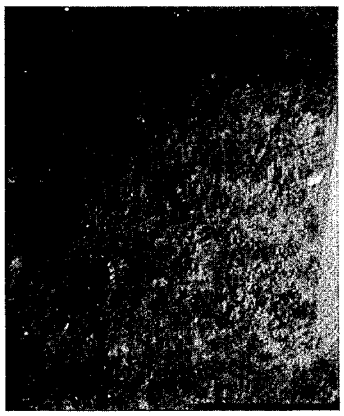
FIGS. 8 and 9 are electron microscope photographs respectively showing macro-structure of oxide layer formed by the conventional method, and that formed by the method according to the present invention.

The oxide layer obtained by the anodic oxidation procedure as shown in EXAMPLE 6 was subjected to pore sealing treatment in boiling water for subsequent investigation into the macro-structure thereof, with results as shown in an electron microscope photograph of FIG. 8. Although the oxide layer treated as described above had a comparatively smooth surface with volume resistivity of approximately $10^9$ Ω·cm and electrostatic capacity higher than 20,000 pF/cm$^2$, the smoothness thereof was inferior to that in FIG. 9, and its charging characteristics were extremely inferior as represented by a curve K in FIG. 7.

Comparative experiment 10

Under the same conditions as in EXAMPLE 1 except for raising the electrolytic temperatures up to 50° to 60° C., the anodic oxidation was carried out to obtain an oxide layer of 18μ in thickness. From the charging characteristics of said oxide layer represented by a curve L in FIG. 7, it is seen that the oxide layer thus obtained is not suited to practical application, with the initial stage surface potential of −67 V and dark attenuation down to −52 V after elapse of 30 seconds. For reference, the charging characteristics of the oxide layers obtained in the comparative experiments 1 and 7 are also plotted in FIG. 7 by the curves B and E.

It is to be noted here that the dielectric members obtained by the foregoing process according to the present invention are applied, for example, to a printer in which development is effected by the function of a needle electrode.

Although the present invention has been fully described by way of example with reference to the accompanying drawings, it is to be noted that various changes and modifications are apparent to those skilled in the art. Therefore, unless otherwise such changes and modifications depart from the scope of the present invention, they should be construed as included therein.

What is claimed is:

1. A process for manufacturing a dielectric member having volume resistivity of at least $10^{11}$ Ω·cm from aluminum or aluminum alloy, which comprises a first step of subjecting the aluminum or aluminum alloy to anodic oxidation in a non-aqueous electrolytic solution containing an organic solvent and dehydrated boric acid and at an electrolytic temperature of at least about 30° C. to form an oxide layer on the aluminum or aluminum alloy, the dehydrated boric acid being formed by heating boric acid at a temperature of about 80°±10° C. for more than one hour, and a second step of buffing the surface of the oxide layer with a composition containing insulative abrasive grains and insulative binding material.

2. A process as claimed in claim 1, wherein said anodic oxidation is effected at an electrolytic temperature of about 30° to 40° C.

3. A process for manufacturing a dielectric member having volume resistivity of at least $10^{11}$ Ω·cm from aluminum or aluminum alloy, which comprises a first step of subjecting the aluminum or aluminum alloy to anodic oxidation in a non-aqueous electrolytic solution containing an organic solvent and dehydrated boric acid in a weight ratio of organic solvent to dehydrated boric acid of about 2:1 and at an electrolytic temperature of about 30° to 40° C. to form a porous oxide layer on the aluminum or aluminum alloy, the dehydrated boric acid being formed by heating boric acid at a temperature of about 80°±10° C. for more than one hour, and a second step of treating the surface of the porous oxide layer by buffing said surface with a composition containing insulative abrasive grains and insulative binding material to seal the pores in said layer.

4. A process as claimed in claim 3, wherein said organic solvent is selected from the group consisting of formamide, N-methyl formamide, dimethyl formamide and an alcohol, and said insulative abrasive grains are selected from the group consisting of alumina, chromium oxide and iron oxide.

5. A process as claimed in claim 2, 4, 1 or 3, wherein said organic solvent is selected from the group consisting of formamide, N-methyl formamide and dimethyl formamide.

* * * * *